US010829944B2

(12) United States Patent
Nesme et al.

(10) Patent No.: US 10,829,944 B2
(45) Date of Patent: Nov. 10, 2020

(54) ADHESIVE BASEBOARD

(71) Applicant: 3M INNOVATIVE PROPERTIES COMPANY, St. Paul, MN (US)

(72) Inventors: Mathieu Nesme, Dijon (FR); Regis A. Gau, Varces Allieres et Risset (FR); Renaud Faye, Saint Jean d'Illac (FR); Richard Cénée, Sannois (FR); Pierre-Alexandre Bourgeois, Essen (DE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/097,082

(22) PCT Filed: Apr. 26, 2017

(86) PCT No.: PCT/US2017/029685
§ 371 (c)(1),
(2) Date: Oct. 26, 2018

(87) PCT Pub. No.: WO2017/189755
PCT Pub. Date: Nov. 2, 2017

(65) Prior Publication Data

US 2019/0106889 A1 Apr. 11, 2019

Related U.S. Application Data

(60) Provisional application No. 62/329,238, filed on Apr. 29, 2016.

(51) Int. Cl.
*E04F 19/04* (2006.01)
*E04F 13/06* (2006.01)

(52) U.S. Cl.
CPC ..... *E04F 19/0477* (2013.01); *E04F 13/06* (2013.01); *E04F 2019/0422* (2013.01); *E04F 2019/0431* (2013.01)

(58) Field of Classification Search
CPC ..... E04F 19/0477; E04F 13/06; E04F 2019/0422; E04F 2019/0431
See application file for complete search history.

(56) References Cited

U.S. PATENT DOCUMENTS 2,178,501 A * 10/1939 Staneampiano ..... E04F 19/045 52/288.1
4,121,008 A 10/1978 Seddon
(Continued)

FOREIGN PATENT DOCUMENTS

DE 2217424 4/1972
DE 2217424 A1 * 10/1973 ..... E04F 19/04
(Continued)

OTHER PUBLICATIONS

International Search report for PCT International Application No. PCT/US2017/029685 dated Jul. 13, 2017, 5 pages.

*Primary Examiner* — Adriana Figueroa
(74) *Attorney, Agent, or Firm* — Kevin Weber

(57) ABSTRACT

The present disclosure generally relates to baseboards and methods of making and using baseboards. Some baseboards described herein include a foam body having a first major surface opposite and separated from a second major surface and a top surface opposite and separated from a bottom surface; the foam body including a foam having a density of between about 20 kg/m$^3$ and about 100 kg/m$^3$; a rigid coating on one of the first or second major surfaces of the foam body; the rigid coating having a modulus of elasticity of between about 1000 MPa and about 10,000 MPa and a thickness of between about 200 to about 1000 micrometers; and optionally an adhesive layer on the other of the first or second major surfaces of the foam body. In some embodiments, the baseboards have a modulus of elasticity of at least 100 MPa. This ensures that they are sufficiently rigid while remaining hand-cuttable.

18 Claims, 4 Drawing Sheets

(56) References Cited

U.S. PATENT DOCUMENTS

| | | | | |
|---|---|---|---|---|
| 5,437,924 | A | 8/1995 | Decker, III | |
| 5,695,870 | A | 12/1997 | Kelch | |
| 6,253,510 | B1 * | 7/2001 | Santarossa | E04F 19/0436 428/69 |
| 2003/0145540 | A1 * | 8/2003 | Brunedal | E04F 19/04 52/285.1 |
| 2005/0284055 | A1 * | 12/2005 | Piche | E04F 19/045 52/287.1 |
| 2007/0175139 | A1 * | 8/2007 | Nicolson | B28B 7/346 52/309.17 |
| 2009/0049780 | A1 | 2/2009 | Pulte | |
| 2015/0068143 | A1 * | 3/2015 | Plenet | E04F 19/0486 52/287.1 |
| 2015/0107175 | A1 * | 4/2015 | Frazier | B05D 3/12 52/309.1 |

FOREIGN PATENT DOCUMENTS

| | | | | |
|---|---|---|---|---|
| DE | 19606126 | | 2/1996 | |
| EP | 1571273 | | 7/2005 | |
| FR | 2896525 | | 1/2006 | |
| FR | 2972472 | | 3/2011 | |
| FR | 2972472 | A1 * | 9/2012 | E04F 19/04 |
| JP | 2003129652 | | 10/2001 | |
| JP | 2006177035 | A * | 7/2006 | |
| NL | 8400968 | | 3/1984 | |
| WO | WO 2013-167559 | | 11/2013 | |

* cited by examiner

ADHESIVE BASEBOARD

CROSS REFERENCE TO RELATED APPLICATIONS

This application is a national stage filing under 35 U.S.C. 371 of PCT/US2017/029685, filed Apr. 26, 2017, which claims the benefit of provisional Application No. 62/329,238, filed Apr. 29, 2016, the disclosure of which is incorporated by reference in its/their entirety herein.

TECHNICAL FIELD

The present disclosure generally relates to baseboards and methods of making and using baseboards.

BACKGROUND

Baseboards are commonly applied to a wall and/or floor to mask irregularities or dilatation seals between the edge of a flooring and a wall.

Patent references FR-A-2 896 525 and JP-A-2003 129652 describe adhesive baseboards made of a supple composite material and including an adhesive on the side to be adhered to the wall. These baseboards are rollable, which makes installation easy.

Patent reference NL 8400968 describes a baseboard made of a foam body coated with an adhesive on one side and a finishing coating on the other side (the visible side). To make the baseboard rollable, the baseboard coating includes a flap intended to be folded against the upper edge of the foam body during installation. This right-angle flap is unattractive and constitutes, after installation, a dust trap.

Patent Application Publication No. US 2015/0068143 describes a rollable, adhesive baseboard including a foam body adjacent to a rigid decorative coating (on the visible when in use side of the baseboard).

Patent Application Publication No. EP2013/059432 describes a rigid baseboard including a foam body having a rigid coating on the first major surface and an adhesive on the second major surface. The adhesive adheres the baseboard to a wall.

SUMMARY

The inventors of the present disclosure recognized that some of the above-described adhesive baseboards were too flexible and looked "cheap." Alternatively, the inventors the present disclosure recognized that some existing adhesive baseboards described above were too rigid to permit a user to cut them by hand (e.g., with a knife or similar hand tool). As such, the inventors of the present disclosure wished to invent a novel baseboard that was at least one of cuttable by a hand tool/by hand while having sufficient rigidity.

Some embodiments of the present disclosure relate to an baseboard including (1) a foam body having a first major surface opposite and separated from a second major surface and a top surface opposite and separated from a bottom surface; the foam body including a foam having a density of between about 20 kg/m$^3$ and about 100 kg/m$^3$; (2) a rigid coating on one of the first or second major surfaces of the foam body; the rigid coating having a modulus of elasticity of between about 1000 MPa and about 10,000 MPa and a thickness of between about 200 to about 1000 micrometers; and optionally (3) an adhesive layer on the other of the first or second major surfaces of the foam body; wherein the baseboard has a modulus of elasticity of at least 100 MPa.

In some embodiments, the foam body has a thickness between a first major surface and a second major surface of between about 0.5 cm and about 2 cm and a height between a top surface and a bottom surface of between about 3 cm and about 15 cm.

In some embodiments, the foam body is a polyethylene foam.

In some embodiments, the rigid coating is plastic.

In some embodiments, the rigid coating has a modulus of elasticity of between about 2500 MPa and about 6000 MPa.

In some embodiments, the rigid coating is thermoformed.

In some embodiments, the rigid coating has a thickness of between about 400 micrometers and about 600 micrometers.

DETAILED DESCRIPTION

Various embodiments and implementations will be described in detail. These embodiments should not be construed as limiting the scope of the present application in any manner, and changes and modifications may be made without departing from the spirit and scope of the inventions. Further, only some end uses have been discussed herein, but end uses not specifically described herein are included within the scope of the present application. As such, the scope of the present application should be determined by the claims.

Figure 1:
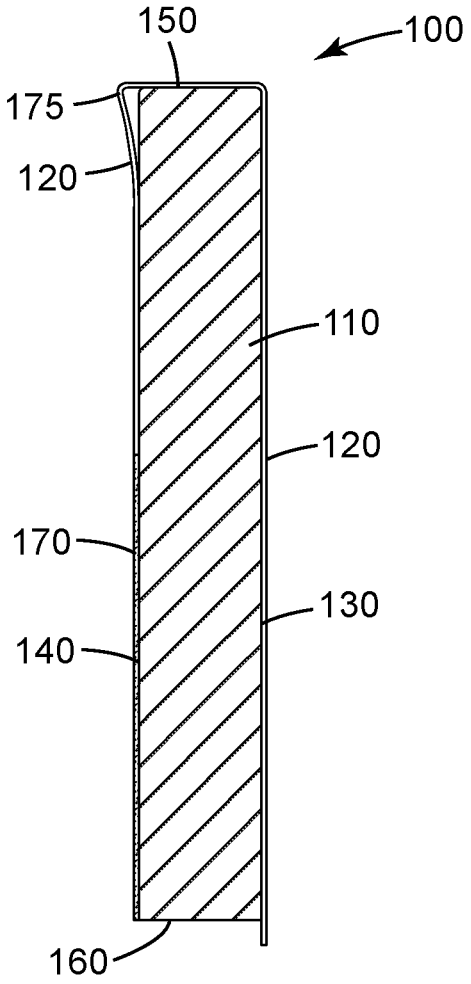
FIG. 1 is a side view of one embodiment of an exemplary baseboard generally according to the teachings herein.

FIG. 1 is a side view of an exemplary embodiment of a baseboard 100. Baseboard 100 includes a foam body 110 including first and second major surfaces, 130 and 140, respectively, top surface 150, and bottom surface 160. First major surface 130, top surface 150, and a portion of second major surface 140 are covered with a relatively thin layer of a rigid and/or decorative coating 120. The presence of the rigid coating on these portions of the foam body provide stiffness or rigidity to the overall baseboard construction. The portion of second major surface 140 not coated with coating 120 includes a pressure sensitive adhesive layer 170. The portion of the foam not coated with the rigid coating has greater conformability than the portion that is coated with a rigid coating. As such, the portion lacking the rigid coating can be applied to non-planar, non-flat, or textured/bumpy surfaces like, for example, a glass fiber wall covering or plaster. In the embodiment in FIG. 1, a free lower end of rigid coating 120 protrudes from foam body 110. This may allow adaptation for any irregularities in the floor against which the baseboard is installed. In some embodiments, the free lower end has a length of between about 0.1 cm and about 1 cm.

In the embodiment shown in FIG. 1, a portion of rigid coating 120 is distanced or separated from second major surface 140 of foam body 110 to form a lip 175. Lip 175 facilitates alignment of the rigid coating with the thickness of the foam. Foam often has significant thickness variation (up to 10%). It can be challenging to accommodate such variations in a mechanical design. Lip 175 allows the top of the baseboard to always be of the same width whatever the thickness tolerance of the foam. It also help the baseboard top surface to maintain contact with the wall and to minimize or eliminate the presence of a detectable (by the eye) gap between the baseboard and the wall, which users often find to be undesirable. Lip 175 can be separated from the surface of the foam of by between about 0 mm and about 2 mm. Lip 175 can extend up to 10 mm along the length of the second major surface (this is not a precise measurement, it can be more if the length of the coating on the second major surface is longer).

Figure 2:
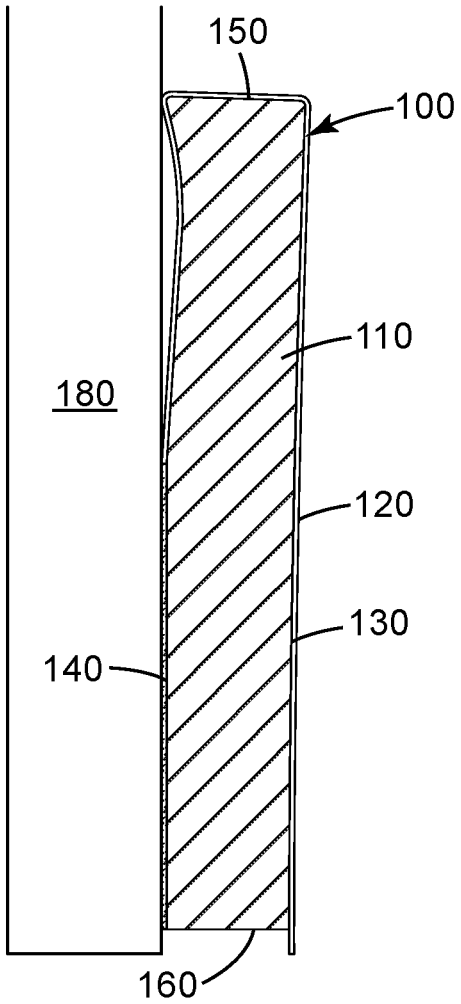
FIG. 2 is a side view of the baseboard of FIG. 1 on a wall.

FIG. 2 is a side view of the baseboard 100 of FIG. 1 applied to a wall 180.

Figure 3:
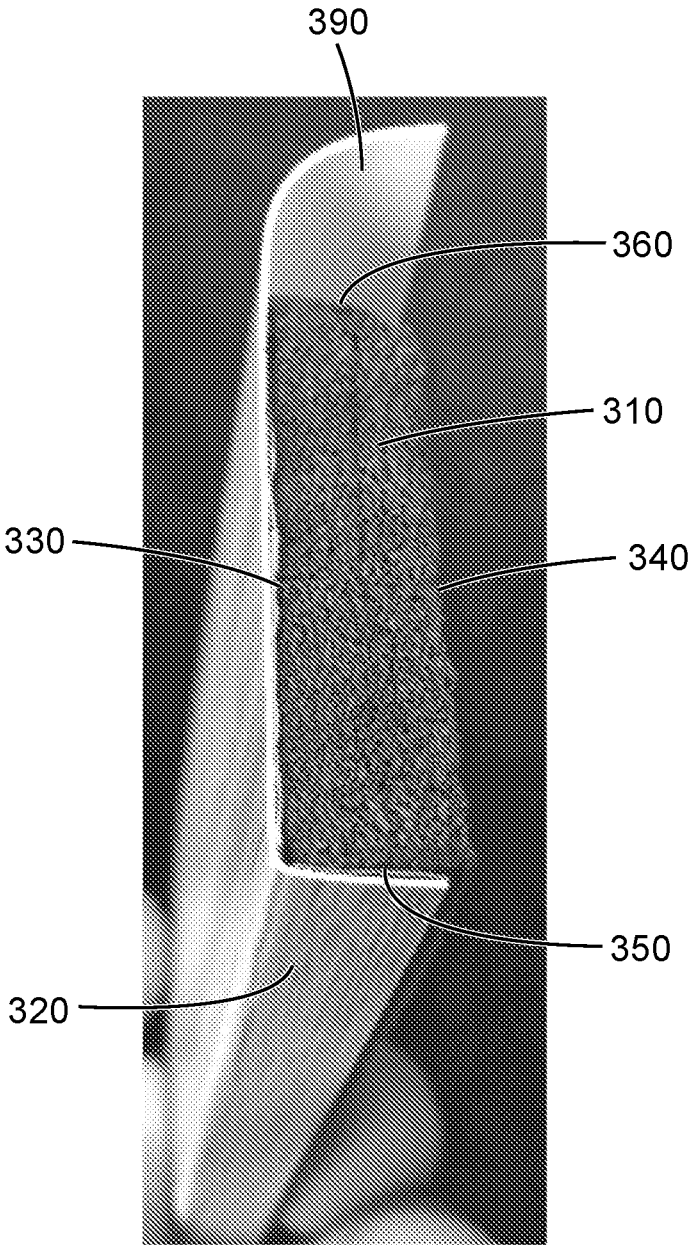
FIG. 3 is a photographic view of another embodiment of an exemplary baseboard generally according to the teachings herein.

FIG. 3 is a photograph of an exemplary embodiment of an adhesive baseboard 300. Baseboard 300 includes a foam body 310 including first and second major surfaces, 330 and 340, respectively, top surface 350, and bottom surface 360. First major surface 330 and bottom surface 360 are covered with a relatively thin layer of a rigid and/or decorative coating 320. In the embodiment shown in FIG. 3, coating 320 is flush with the floor (in other words, it does not extend downward to form a free lower end as shown in the embodiment of FIG. 1). In some embodiments and as seen in the photograph in FIG. 7, this feature may make installation easier by allowing the foam body to rest on or directly adjacent the floor.

Decorative coating 320 extends vertically past first major surface 330 and curves toward second major surface 340 to form a domed section 390. In some embodiments, domed section 390 masks an empty space devoid of foam. In some embodiments, cables (e.g., electrical, digital, or telecommunication) can be passed through the space under domed section 390. In some embodiments, the rigid coating has sufficient elasticity to regain its domed shape after an operator acts to deform domed section 390 temporarily to place the wires or cables. The portion of second major surface 340 not coated with coating 320 includes a pressure sensitive adhesive layer 370 (not shown).

Figure 4:
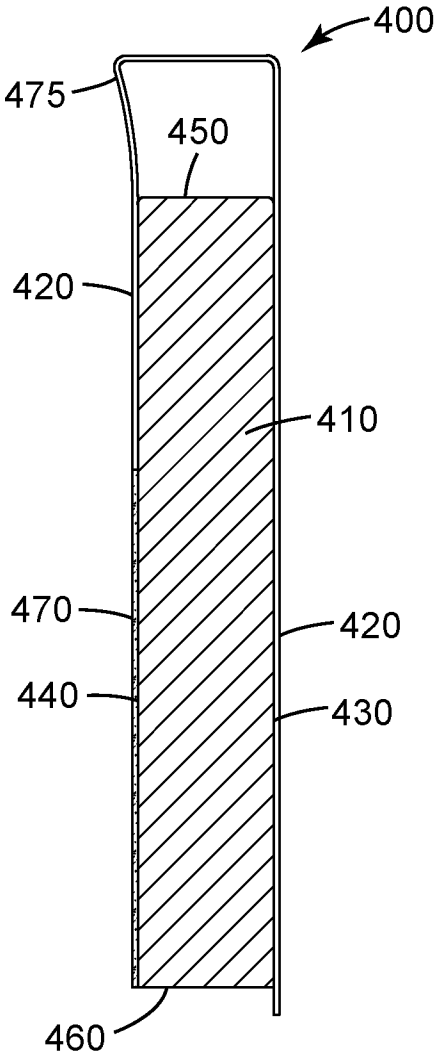
FIG. 4 is a side view of another embodiment of an exemplary baseboard generally according to the teachings herein.

Baseboard 400 shown in FIG. 4 is substantially the same as the embodiment shown in FIG. 1 except that rigid coating 420 extends above and past the top major surface 450 of foam body 410 in a generally rectangular or square shape.

Figure 5:
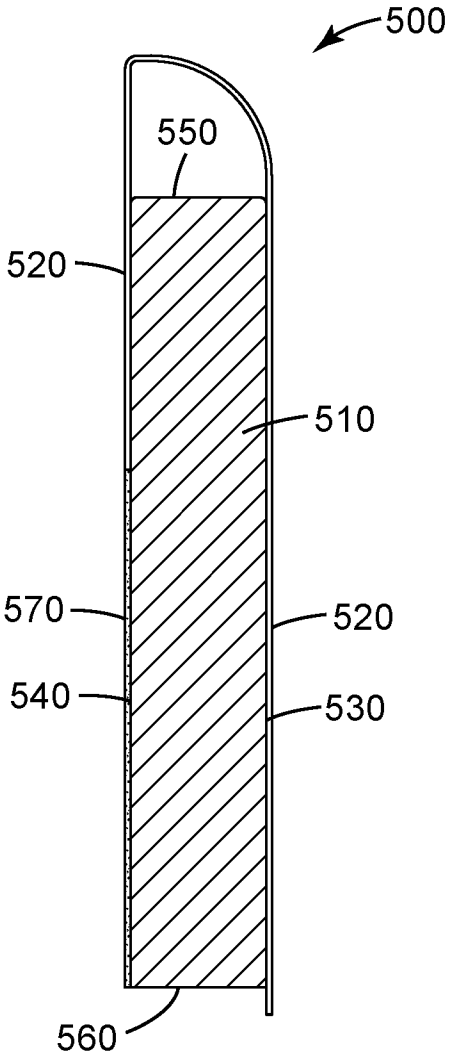
FIG. 5 is a side view of another embodiment of an exemplary baseboard generally according to the teachings herein.

Baseboard 500 shown in FIG. 5 is substantially the same as the embodiment shown in FIG. 4 except that rigid coating 520 extends above and past the top major surface 550 of foam body 510 in an arcuate shape and lacks a lip.

Figure 6:
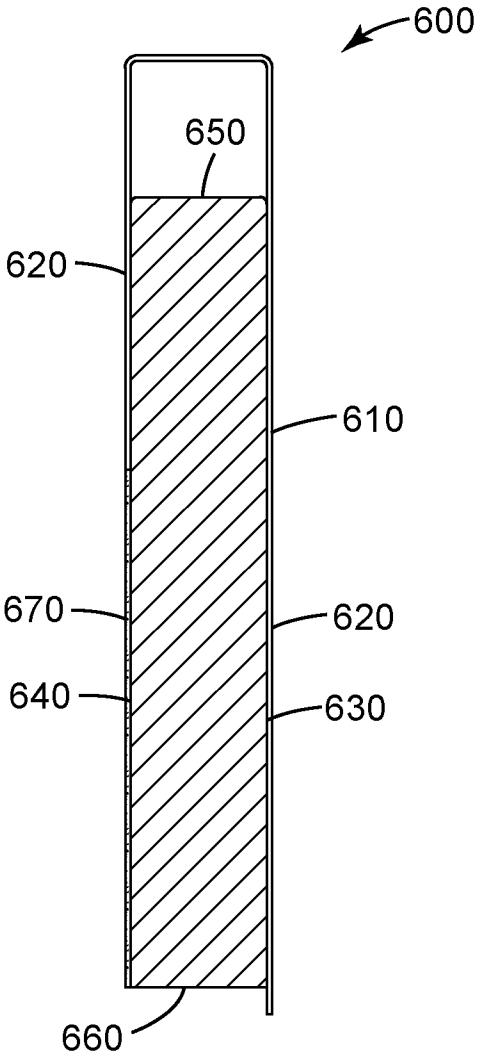
FIG. 6 is a side view of another embodiment of an exemplary baseboard generally according to the teachings herein.
Figure 7:
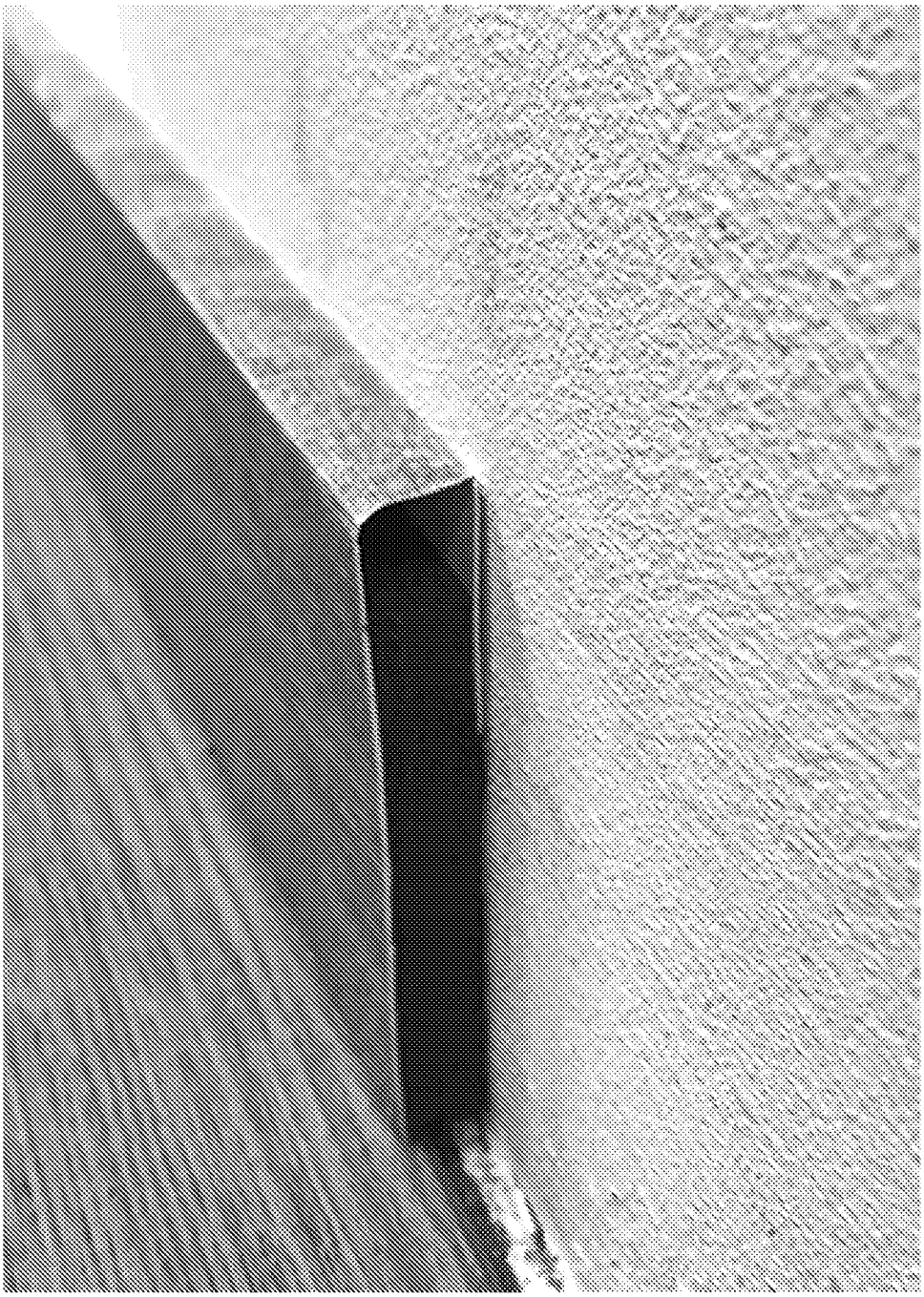
FIG. 7 is a photographic view of the baseboard of FIG. 6 on a wall.

The embodiment shown in FIG. 6 is substantially the same as the embodiment shown in FIG. 4 except that baseboard 600 lacks a lip. When applied to a wall, as shown in the photograph of FIG. 7, the foam body to rest on or directly adjacent the floor and the second major surface 640 to rest against or directly adjacent to the wall.

The layers and components of the above exemplary embodiments are described in greater detail below.

Foam

The foam can be any known foam including, for example, polyethylene foam. In some embodiments, the density of the foam is between about 20 and 100 kg/m$^3$. Some embodiments have a foam density of greater than 20 kg/m$^3$, greater than 25 kg/m$^3$, greater than 30 kg/m$^3$, greater than 35 kg/m$^3$, greater than 40 kg/m$^3$, greater than 45 kg/m$^3$, greater than 50 kg/m$^3$, greater than 55 kg/m$^3$, greater than 60 kg/m$^3$, etc. Some embodiments have a density less than 100 kg/m$^3$, less than 90 kg/m$^3$, less than 80 kg/m$^3$, less than 70 kg/m$^3$, less than 60 kg/m$^3$, less than 50 kg/m$^3$, etc. Foam density can be measured by scaling a piece of foam and dividing the weight by the precisely measured volume of the foam.

In some embodiments, the foam has a thickness between the first and second major surfaces of between about 0.5 cm and about 2 cm. In some embodiments, the foam has a height between the top surface and the bottom surface of between about 3 cm and about 15 cm.

In some embodiments, the foam is extruded, crosslinked, or a cast foam.

Rigid Coating

The rigid coating can be made of any desired material, including, for example, a synthetic material, plastic film, or similar material. In some embodiments, the rigid film is thermoformable. The coating can be thermoformed before or after being attached or adhered to the foam.

In some embodiments, the rigid coating has a modulus of elasticity of between about 1000 MPa to about 10,000 MPa. In some embodiments, the rigid coating has a modulus of elasticity of at least 1000 MPa, at least 1200 MPa, at least 1400 MPa, at least 1600 MPa, at least 1800 MPa, at least 2000 MPa, etc. In some embodiments, the rigid coating has a modulus of elasticity of less than 10,000 MPa, less than 9000 MPa, less than 8000 MPa, less than 7000 MPa, less than 6000 MPa, etc. The modulus of elasticity of the rigid coating can be measured by the tensile test of ASTM D638-14.

The rigid coating preferably has a thickness of between about 200 to about 1000 micrometers (about 0.2 mm to about 1 mm). Some embodiments have a thickness of greater than 200 micrometers, greater than 225 micrometers, greater than 250 micrometers, greater than 275 micrometers, greater than 300 micrometers, greater than 325 micrometers, greater than 350 micrometers, greater than 375 micrometers, greater than 400 micrometers, greater than 425 micrometers, greater than 450 micrometers, greater than 475 micrometers, greater than 500 micrometers, etc. Some embodiments have a thickness of less than 1000 micrometers, or less than 900 micrometers, or less than 800 micrometer, or less than 700 micrometers, etc. Coating thickness can be measured using a standard micrometer.

The rigid coating can be applied to the foam in any desired way including, for example, by adhesive, gluing, overmolding, or welding. In some embodiments, the rigid coating is painted. In some embodiments, the rigid coating appears uniform, wooden or has an outer surface looking like a metal, marble, tile, a mirror or any other coating.

Adhesive Layer

The adhesive layer is intended to adhere the baseboard to a wall. Any desired adhesive layer may be used. Some exemplary adhesives include, for example, acrylic (water or solvent based), rubber, silicone, or hot melt pressure sensitive adhesives. The adhesives can be repositionable so as to allow the baseboard to be removed or replaced without damaging it. In some embodiments, the adhesive layer is not continuous. In some embodiments, the adhesive layer is formed of adhesive lines coated on the foam body In some embodiments, the adhesive is adjacent to a release liner. In some embodiments, such as when a baseboard is supplied in a kit, the adhesive layer can be a double-faced adhesive tape.

Baseboard

The baseboards of the present disclosure are preferably cuttable or able to be cut by hand with a hand-held knife or similar tool. For example, some embodiments can be cut using a box cutter or knife. The baseboard are also preferably rigid enough that they will not bend or deflect significantly when held.

In some embodiments, the baseboard has a modulus of elasticity of at least 100 MPa. In some embodiments, the baseboard has a modulus of elasticity of at least 110 MPa, 120 MPa, 130 MPa, 140 MPa, 150 MPa, 160 MPa, 170 MPa, 180 MPa, 190 MPa, or 200 MPa. The modulus of elasticity of the baseboard can be measured by fixing one end and measuring the deflection of the opposing end. With the section second moment of area (also referred to as the moment of inertia), the length of the baseboard, and its linear weight, the modulus of elasticity can be calculated using the following formula:

$$E=q*L^4/(8*f*I)$$

Where

E=modulus of elasticity (MPa)

q=weight (N/mm)

L=length of the baseboard (mm)

f=deflection (mm)

I=moment of inertia ($mm^4$).

In some embodiments the baseboard has a modulus of elasticity such that a 1 m baseboard does not deflect by more than about 100 mm at one end when held from the other end.

The baseboards of the present disclosure may be installed on a straight line or on a wall edge and may be particularly suited to curves and wall irregularities. Moreover, they may cover inside and outside corners to give optimal finish.

Reference throughout this specification to "one embodiment," "some embodiments," "one or more embodiments" or "an embodiment," whether or not including the term "exemplary" preceding the term "embodiment," means that a particular feature, structure, material, or characteristic described in connection with the embodiment is included in at least one embodiment of the certain exemplary embodiments of the present disclosure. Thus, the appearances of the phrases such as "in one or more embodiments," "in certain embodiments," "in one embodiment" or "in an embodiment" in various places throughout this specification are not necessarily referring to the same embodiment of the certain exemplary embodiments of the present disclosure. Furthermore, the particular features, structures, materials, or characteristics may be combined in any suitable manner in one or more embodiments.

The recitation of all numerical ranges by endpoint is meant to include all numbers subsumed within the range (i.e., the range 1 to 10 includes, for example, 1, 1.5, 3.33, and 10).

The terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

All references mentioned herein are hereby incorporated by reference in their entirety.

With reference to the Figures, like numerals are used to designate like components throughout the set of Figures.

Those having skill in the art will appreciate that many changes may be made to the details of the above-described embodiments and implementations without departing from the underlying principles thereof. Further, various modifications and alterations of the present invention will become apparent to those skilled in the art without departing from the spirit and scope of the invention. The scope of the present application should, therefore, be determined only by the following claims and equivalents thereof.

What is claimed is:

1. A baseboard, comprising:

a foam body having a first major surface opposite and separated from a second major surface and a top surface opposite and separated from a bottom surface; the foam body including a foam having a density of between about 20 $kg/m^3$ and about 100 $kg/m^3$; and a rigid coating adjacent to and covering at least a portion of the first major surface and a portion of the second major surfaces of the foam body and adjacent at least one of the top or bottom surfaces of the foam body; the rigid coating having a modulus of elasticity of between about 1000 MPa and about 10,000 MPa and a thickness of between about 200 to about 1000 micrometers, wherein the baseboard has a modulus of elasticity of at least 100 MPa, wherein the rigid coating extends continuously from the first major surface up and over the top surface to the second major surface, and wherein the rigid coating is in contact with the top surface and forms a lip spaced laterally from the second major surface of the foam body, the lip extending outward in a plane parallel to the top surface.

2. The baseboard of claim 1, and further comprising an adhesive layer on a portion of the second major surface of the foam body not covered by the rigid coating.

3. The baseboard of claim 1, wherein the foam body has a thickness between a first major surface and a second major surface of between about 0.5 cm and about 2 cm and a height between a top surface and a bottom surface of between about 3 cm and about 15 cm.

4. The baseboard of claim 1, wherein the foam body is a polyethylene foam.

5. The baseboard of claim 1, wherein the rigid coating is plastic.

6. The baseboard of claim 1, wherein the rigid coating has a modulus of elasticity of between about 2500 MPa and about 6000 MPa.

7. The baseboard of claim 1, wherein the rigid coating is thermoformed.

8. The baseboard of claim 1, wherein the rigid coating has a thickness of between about 400 micrometers and about 600 micrometers.

9. The baseboard of claim 1, wherein the rigid coating extends at least an entire height of the first major surface.

10. The baseboard of claim 9, wherein the rigid coating is on the top surface of the foam body.

11. The baseboard of claim 9, wherein the rigid coating is on the bottom surface of the foam body.

12. A baseboard, comprising:

a foam body having a first major surface opposite and separated from a second major surface and a top surface opposite and separated from a bottom surface;

a rigid coating adjacent to and covering at least a portion of the first major surface and a portion of the second major surfaces of the foam body and at least one of the top or bottom surfaces of the foam body; the rigid coating having a modulus of elasticity of between about 1000 MPa and about 10,000 MPa; and an adhesive layer on a portion of the second major surface of the foam body not covered by the rigid coating, wherein the baseboard has a modulus of elasticity of at least 100 MPa, wherein the rigid coating extends from the first major surface up and over the top surface to the second major surface, and wherein the rigid coating is in contact with the top surface and forms a lip spaced laterally from the second major surface of the foam body, the lip extending outward in a plane parallel to the top surface.

13. The baseboard of claim 12, wherein the foam body includes a foam having a density of between about 20 $kg/m^3$ and about 100 $kg/m^3$.

14. The baseboard of claim 12, wherein the rigid coating has a thickness of between about 400 micrometers and about 600 micrometers.

15. A kit comprising the baseboard of claim 1 and an adhesive.

16. The kit of claim 15, wherein the adhesive comprises a double-faced adhesive tape.

17. The baseboard of claim 1, wherein the rigid coating contacts the top surface as it extends from the first major surface to the second major surface.

18. The baseboard of claim 17, wherein the rigid coating extends above and past the top surface.

* * * * *